US009211627B2

(12) United States Patent
Andou et al.

(10) Patent No.: US 9,211,627 B2
(45) Date of Patent: Dec. 15, 2015

(54) POLISHING APPARATUS

(75) Inventors: Kazutoshi Andou, Tokyo (JP); Toshinori Kimura, Tokyo (JP); Sadaaki Mizuno, Kawasaki (JP)

(73) Assignees: NTT Advanced Technology Corporation, Tokyo (JP); Teitsu Engineering Co., LTD., Kanagawa (JP)

( * ) Notice: Subject to any disclaimer, the term of this patent is extended or adjusted under 35 U.S.C. 154(b) by 134 days.

(21) Appl. No.: 13/985,199

(22) PCT Filed: Feb. 9, 2012

(86) PCT No.: PCT/JP2012/000891

§ 371 (c)(1), (2), (4) Date: Aug. 13, 2013

(87) PCT Pub. No.: WO2012/111290

PCT Pub. Date: Aug. 23, 2012

(65) Prior Publication Data

US 2013/0331008 A1 Dec. 12, 2013

(30) Foreign Application Priority Data

Feb. 16, 2011 (JP) ..... 2011-031308

(51) Int. Cl.
*B24B 19/22* (2006.01)

(52) U.S. Cl.
CPC ..... *B24B 19/226* (2013.01)

(58) Field of Classification Search
CPC ..... G02B 6/3863; B24B 19/226
USPC ..... 451/164
See application file for complete search history.

(56) References Cited

U.S. PATENT DOCUMENTS 4,979,334 A * 12/1990 Takahashi ..... 451/271
5,098,347 A 3/1992 Sajczvk et al.
5,218,786 A * 6/1993 Takahashi ..... 451/177
5,813,081 A * 9/1998 Wang et al. ..... 15/210.1

(Continued)

FOREIGN PATENT DOCUMENTS

CN 1773318 5/2006
EP 0579056 A1 * 1/1994 ..... B24B 19/226

(Continued)

OTHER PUBLICATIONS

International Preliminary Report and Written Opinion dated Aug. 29, 2013 from related PCT application No. PCT/JP2012/000891.

(Continued)

*Primary Examiner* — Lee D. Wilson
*Assistant Examiner* — Joel Crandall
(74) *Attorney, Agent, or Firm* — Workman Nydegger

(57) ABSTRACT

Provided is a polishing apparatus capable of maintaining polishing precision although fewer expendable parts are periodically replaced. The polishing apparatus includes a polishing disk (20) having a polishing surface (20*a*) on the front side thereof to polish an end surface of a workpiece, a support mechanism (30) for supporting a back surface (20*b*) of the polishing disk (20) while allowing the polishing disk (20) to move along a predetermined plane, a workpiece holder (50) for holding the workpiece so as to contact the end surface of the workpiece with the polishing surface of the polishing disk, and a driving mechanism (70) for concurrently causing circular and reciprocating rectilinear motions of the polishing disk (20).

13 Claims, 14 Drawing Sheets

(56) References Cited

U.S. PATENT DOCUMENTS

| | | | | |
|---|---|---|---|---|
| 5,823,859 | A * | 10/1998 | Erdogan et al. | 451/65 |
| 6,165,055 | A | 12/2000 | Takahashi et al. | |
| 6,190,239 | B1 * | 2/2001 | Buzzetti | 451/42 |
| 6,681,437 | B1 * | 1/2004 | Miyake et al. | 15/210.1 |
| 6,918,816 | B2 * | 7/2005 | Bianchi | 451/11 |
| 2001/0021631 | A1 | 9/2001 | Minami et al. | |
| 2001/0024931 | A1 | 9/2001 | Buzzetti | |
| 2002/0108636 | A1 * | 8/2002 | Childers et al. | 134/6 |
| 2003/0054741 | A1 * | 3/2003 | Ling et al. | 451/177 |
| 2003/0148713 | A1 * | 8/2003 | Minami et al. | 451/41 |
| 2004/0093970 | A1 * | 5/2004 | Iida et al. | 74/89.33 |
| 2008/0113593 | A1 * | 5/2008 | Ling | 451/285 |
| 2011/0070812 | A1 * | 3/2011 | Hsieh et al. | 451/259 |

FOREIGN PATENT DOCUMENTS

| | | | |
|---|---|---|---|
| JP | 61-284380 | | 12/1986 |
| JP | S62-255056 | | 11/1987 |
| JP | 64-12164 | | 1/1989 |
| JP | 04-244646 | | 9/1992 |
| JP | 08-257854 | | 10/1996 |
| JP | 10-235542 | | 9/1998 |
| JP | 2000-84822 | | 3/2000 |
| JP | 2001-259986 | | 9/2001 |
| JP | 2003-11047 | | 1/2003 |
| JP | 2003011047 | A * | 1/2003 |
| JP | 2003-205446 | | 7/2003 |
| JP | 3773851 | | 2/2006 |
| KR | 10-2005-0030092 | | 3/2005 |

OTHER PUBLICATIONS

Office Action in corresponding Japanese Patent Application No. 2011-031308 recieved Oct. 14, 2014.

* cited by examiner

POLISHING APPARATUS

TECHNICAL FIELD

The present invention relates to a polishing apparatus, particularly to a polishing apparatus suitable for polishing connecting end surfaces of optical fibers.

BACKGROUND ART

Generally, an optical connector used for butt-jointing multiple optical fibers or connecting optical fibers with various optical devices has optical fiber plugs into which the optical fibers are inserted. A conventional optical fiber plug is cylindrically shaped and made of a low expansion material with an excellent wear resistance, such as zirconia ceramics. In a central portion of the connecting end surface of the optical fiber plug, a leading end surface of the optical fiber is exposed. The connecting end surface is formed to have a convex spherical surface with a radius of curvature of about 20 mm.

PTL 1 discloses a polishing apparatus for processing a connecting end surface of an optical fiber plug to have a convex spherical surface with a predetermined curvature. The polishing apparatus disclosed in PTL 1 has a polishing disk having a polishing film adhered to its surface via an elastic sheet and being supported so as to enabling a circular motion in a predetermined plane, and a slider having a plug holder to which an optical fiber plug is mounted. This polishing apparatus reciprocates the slider with respect to the polishing disk while causing the circular motion of the polishing disk in the state where a connecting end surface of an optical fiber plug is pressed against the polishing disk, so that the connecting end surface of the optical fiber plug is polished.

CITATION LIST

Patent Literature

PTL 1: Japanese Patent No. 3773851

SUMMARY OF INVENTION

Technical Problem

By the way, in the polishing apparatus as disclosed above, a support mechanism for supporting a polishing disk so as to allow a circular motion thereof and a guide rail for guiding a slider wear out as used, which may result in variations in parallelism and size of polishing surfaces and sliders, and may fail to achieve a required polishing precision of a connecting end surface of an optical fiber plug. In addition, wear on components in a mechanism for a circular motion of a polishing disk causes backlash in the mechanism, which makes it impossible for a polishing film to exhibit full polishing performance and may degrade appearance characteristics and optical characteristics of a connecting end surface of an optical fiber connector. To maintain polishing precision of a connecting end surface of an optical fiber plug, it is necessary to frequently replace various components, which requires many processes in replacement while increasing the cost of components.

It is an object of the present invention to provide a polishing apparatus which requires fewer expendable parts to be periodically replaced so as to maintain polishing precision.

Solution to Problem

According to one aspect of the present invention, a polishing apparatus includes a polishing disk having a polishing surface for polishing an end surface of a workpiece on one side thereof, a support mechanism configured to support a back surface of the polishing disk on an opposite side to the polishing surface while allowing the polishing disk to move along a predetermined plane, a workpiece holder configured to hold the workpiece so as to contact the end surface of the workpiece with the polishing surface of the polishing disk, and a driving mechanism configured to concurrently cause circular and reciprocating rectilinear motions of the polishing disk.

According to the present invention, circular and reciprocating rectilinear motions of the polishing disk eliminate movement of the workpiece holder, and thus mechanisms for controlling polishing precision can be integrated into a support mechanism. As a result, a reduction of the number of expendable parts, which require replacement periodically to maintain polishing precision of workpieces, can be achieved. In addition, since the workpiece holder is fixed so as not to cause a reciprocating rectilinear motion of a workpiece mounted thereon, it is possible to simplify the holding way of the workpiece in polishing.

DESCRIPTION OF EMBODIMENTS

Referring to the accompanying drawings, embodiments of the present invention will be described below.

Figure 1:
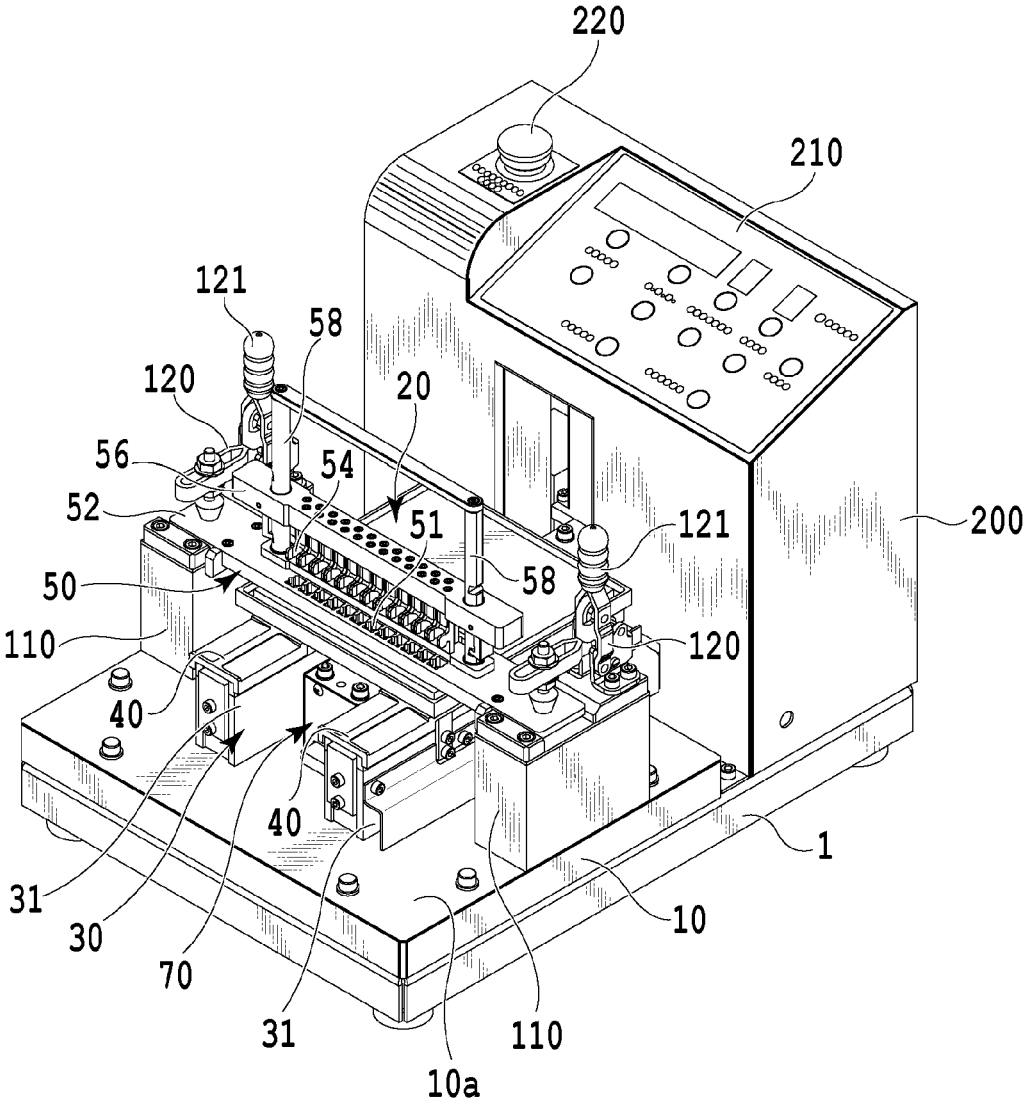
FIG. 1 is a perspective view of a polishing apparatus in accordance with one embodiment of the present invention.
Figure 10:
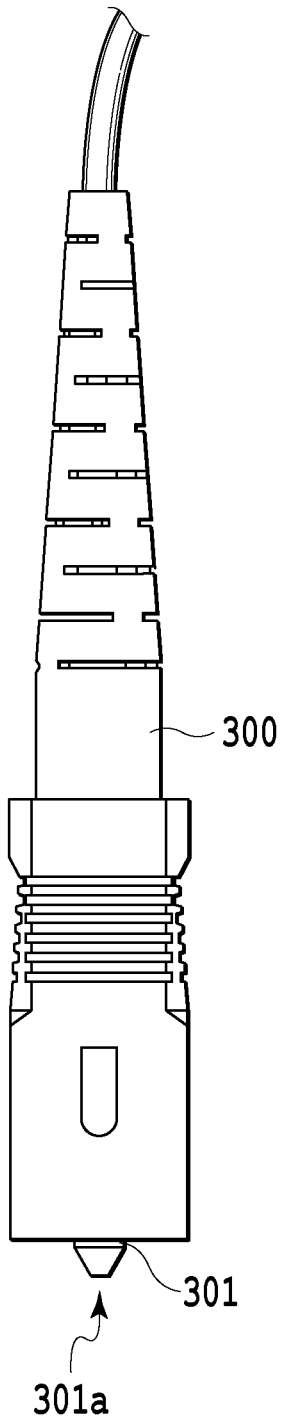
FIG. 10 is a view showing an exemplary optical connector.

FIG. 1 shows an appearance of a polishing apparatus in accordance with one embodiment of the present invention. The polishing apparatus in accordance with the present embodiment is used for polishing a connecting end surface 301*a* of an optical fiber ferrule 301 stored in an optical connector 300 as shown in FIG. 10. The polishing apparatus includes a base 10, a polishing disk 20 having a polishing surface for polishing the connecting end surface 301*a* of the optical fiber ferrule 301, a support mechanism 30 for supporting the polishing disk 20, a driving mechanism 70 for causing circular and reciprocating rectilinear motions of the polishing disk 20, and a workpiece holder 50 for holding a plurality of optical connectors. Note that, herein, a circular motion means a motion of the polishing disk 20 such that movement trajectories of all points on the polishing disk 20 forms a circle having a particular radius.

The base 10 is placed on a working floor surface via a pedestal 1 to which a rubber isolator or the like is embedded. The base 10 is a plate member having a flat mounting surface (reference surface) 10*a* in which a longer side has a length of 300 mm and a shorter side has a length of 250 mm, for example. For the base 10, it is possible to adopt a stone surface plate having an excellent wear resistance and corrosion resistance and being resistant to thermal deformation as compared to general metals such as a cast steel or an aluminum alloy. Although the flatness of the mounting surface 10*a* of the base 10 depends on the number of optical connectors 300 polished at the same time and a distance between the disposed optical connectors 300, generally a precision may have JIS Level 2 or greater. A base 11 made of metal, such as cast iron, SUS430, 50% nickel steel, or common steel, may be adopted as long as the material has a coefficient of linear expansion of $1.1\times10^{-5}$/° C. or smaller. Incidentally, the pedestal 1 has a cover 200 adjacent to the base for covering a motor or a power transmission system of the motor, which will be described later. On the top of the cover 200, an operation unit 210 consisting of various buttons and an indicator lamp or the like and an emergency stop button 220 are provided.

The workpiece holder 50 has a mounting plate 52 in which a plurality of optical connector mounting holes 51 are formed, guide poles 58, each provided for one of end portions of the mounting plate 52, an elevating block 56 which is guided vertically by the guide poles 58, and a plurality of pressing members 54 fixed to the elevating block 56.

The end portions of the mounting plate 52 in a longitudinal direction are placed on top surfaces of two supports 110 which are located apart from each other on the base 1, and top surfaces of the end portions are clamped by toggle clamps 120, each provided for one of the two supports 110, so that the mounting plate 52 is fixed to the supports 110. Incidentally, the toggle clamp 120 is configured to clamp/unclamp the mounting plate 52 by operation of a lever 121. The plurality of optical connector mounting holes 51 are arranged in two rows, the front row and the back row (twelve holes for each row) with a particular distance therebetween along a longitudinal direction of the mounting plate 52. The optical connector mounting holes 51 are arranged such that the back row of the optical connector mounting holes 51 (not shown) is displaced from the front row of the optical connector mounting holes 51 by half an array pitch. The plurality of pressing members 54 are provided to correspond with the plurality of respective optical connector mounting holes 51.

The elevating block 56 is movable in a vertical direction by use of the guide poles 58, and it is also clamped by a clamp mechanism (not shown) at a predetermined position in which the pressing members 54 press the optical connectors 300. Once the elevating block 56 is allowed to rise so that the optical connectors 300 are mounted to the plurality of optical connector mounting holes 51, and then is allowed to come down to be clamped, the optical connectors 300 are pressed downward by the pressing members 54 and mounted to the workpiece holder 50. Thereby, the connecting end surfaces 301*a* of the optical fiber ferrules 301 are pressed against the polishing surface of the polishing disk 20.

Figure 2:
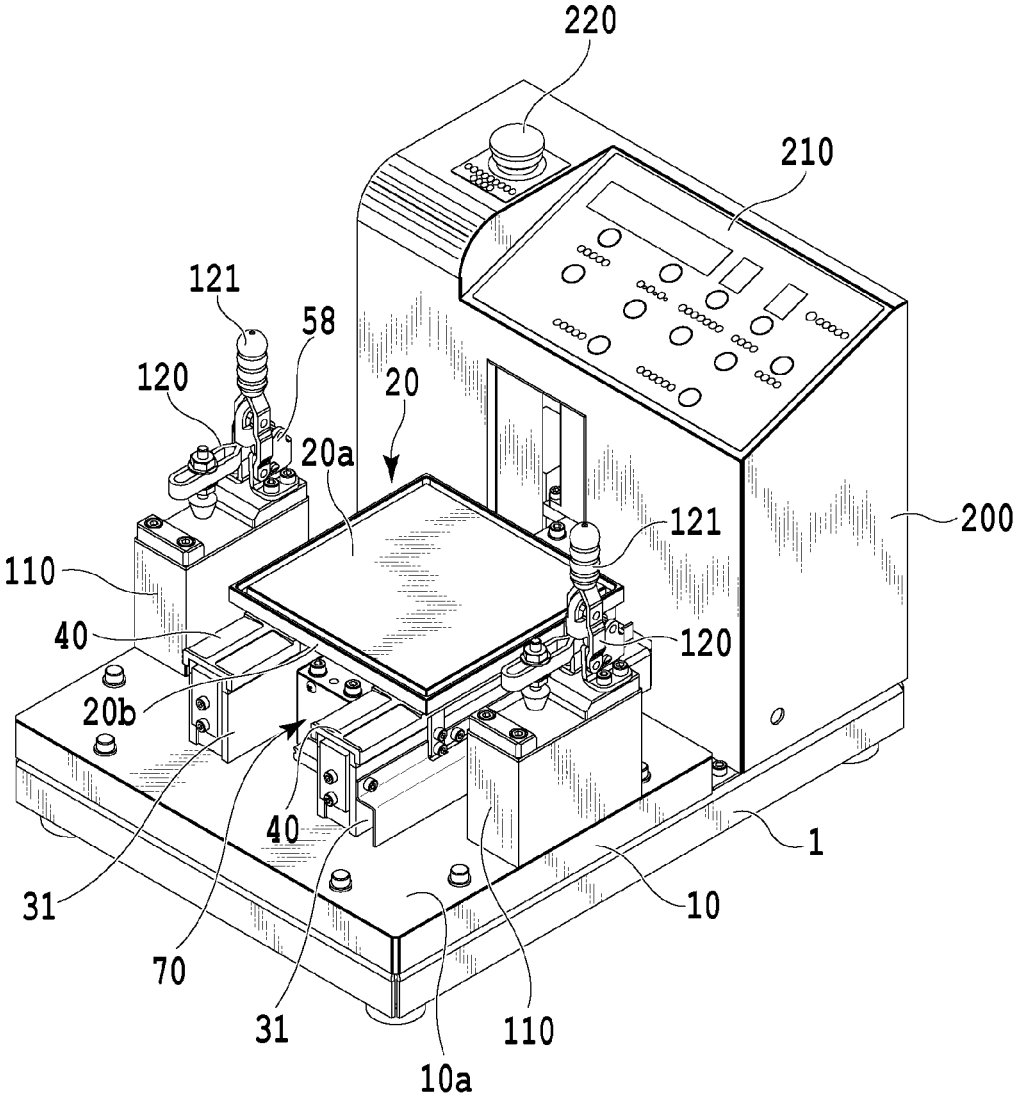
FIG. 2 is a perspective view of the polishing apparatus in which a connector holder is removed from the polishing apparatus of FIG. 1.

FIG. 2 shows the polishing apparatus in which the workpiece holder 50 is removed. As shown in FIG. 2, the polishing disk 20 is a plate member having a substantially square shape. A front surface 20*a* and a back surface 20*b* of the polishing disk 20 are flat surfaces, and a polishing film is adhered to the front surface 20*a* via an elastically deformable elastic sheet. The polishing surface consists of the polishing film. The polishing disk 20 is made of a hard material with an excellent wear resistance, and in particular, the back surface 20*b* supported by rigid balls 45 of the support mechanism 30 is formed so as to have a hardness that is higher than that of the rigid balls 45, which will be described later.

Figure 3:
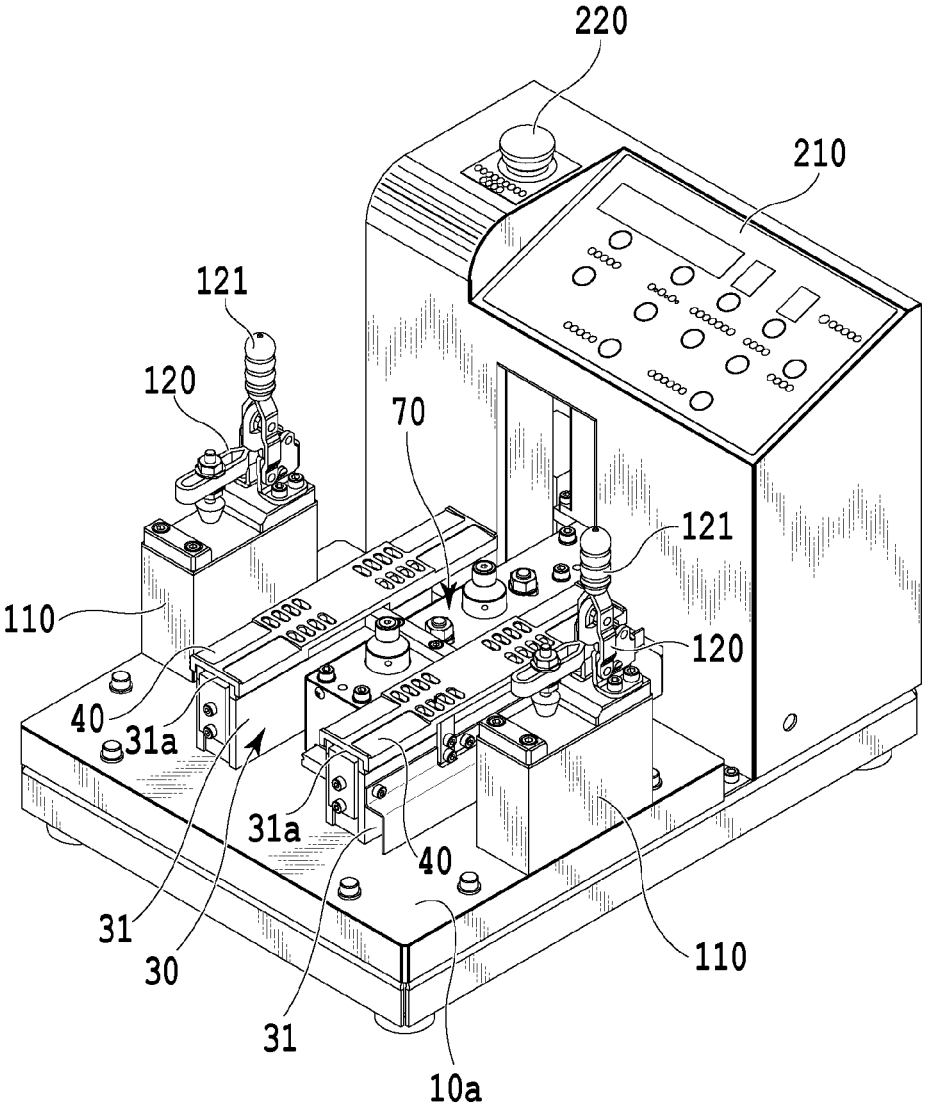
FIG. 3 is a perspective view of the polishing apparatus in which a polishing disk is removed from the polishing apparatus of FIG. 2.

FIG. 3 shows the polishing apparatus in which the polishing disk 20 is further removed from the polishing apparatus of FIG. 2. The support mechanism 30 has two support members 31 disposed between the above-described two supports 110 and installed in parallel on the mounting surface 10*a* of the base 10, the plurality of rigid balls 45, and two guide members 40, each installed on one of top surfaces of the support members 31 for guiding the rigid balls 45.

The support members 31 are installed in parallel with the side surfaces of the base 10, and the top surfaces of the support members 31 serve as flat supporting surfaces 31*a* for supporting the polishing disk 20. The supporting surfaces 31*a* are planes that are in parallel with the mounting surface 10*a* of the base 10. The support members 31 are made of a hard material with an excellent wear resistance as the polishing disk 20, and in particular, the supporting surfaces 31*a* for supporting the rigid balls 45 are formed to have a hardness that is higher than that of the rigid balls 45, as will be described later.

The plurality of rigid balls 45 are disposed between the supporting surface 31*a* of the support member 31 and the back surface 20*b* of the polishing disk 20, and function as a plurality of bearing elements which accept circular and reciprocating rectilinear motions of the polishing disk 20, which will be described later, with respect to the supporting surface 31*a*.

Figure 7:
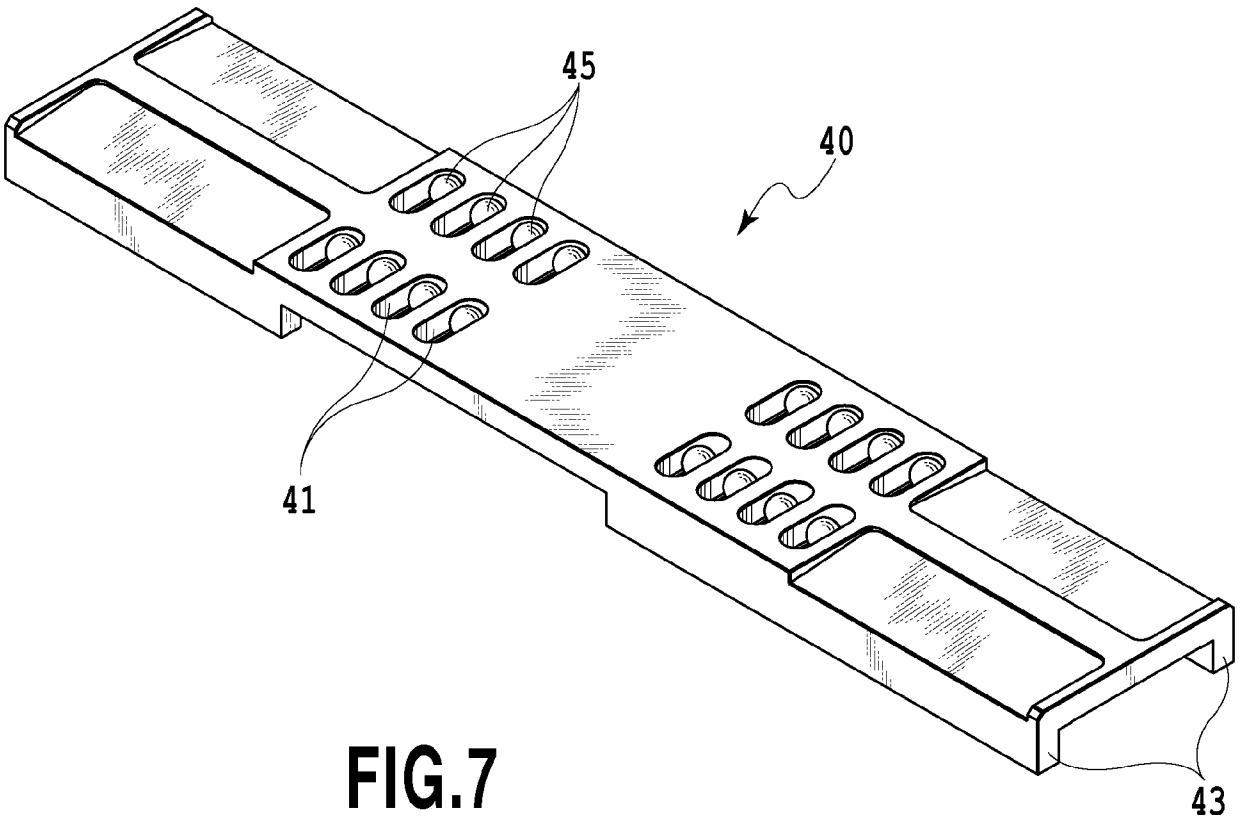
FIG. 7 is a perspective view of a guide member and rigid balls used in the polishing apparatus of FIG. 1.
Figure 8A:
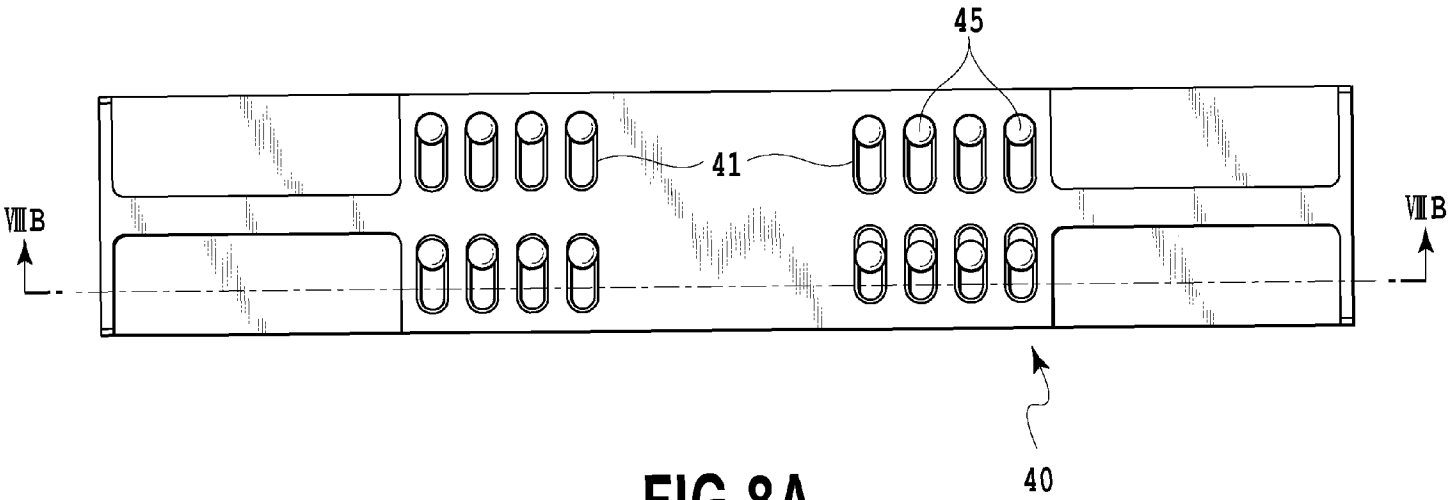
FIG. 8A is a top view of the guide member.
Figure 8B:
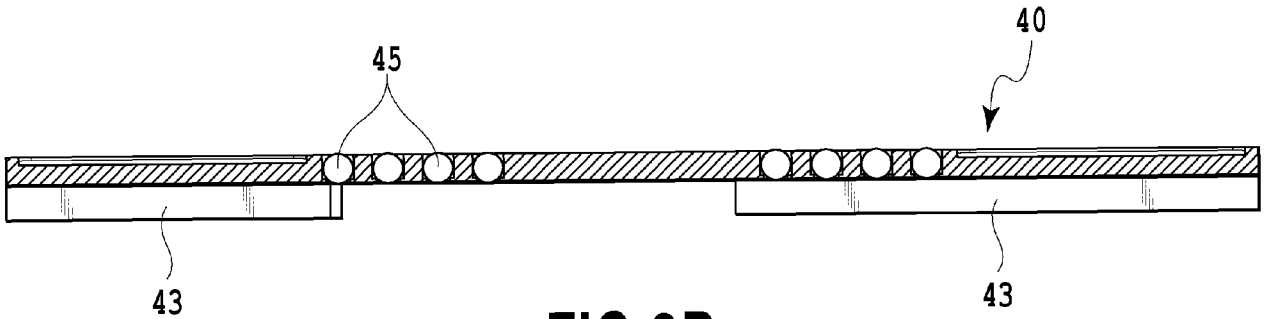
FIG. 8B is a cross-sectional view taken from line VIIIB-VIIIB of FIG. 8A.

Here, FIGS. 7, 8A, and 8B show a structure of the guide member 40. The guide member 40 is a long thin plate member, and has a plurality of guide holes 41 for guiding the respective rigid balls 45, and projections 43 formed on both ends of a plate portion in a transverse direction and projecting downward. A thickness of the plate portion of the guide member 40 is slightly smaller than a diameter of the rigid ball 45 as shown in FIG. 8B. This allows the back surface 20*b* of the polishing disk 20 to come in contact with the plurality of rigid balls 45, but not with the guide member 40, and the polishing disk 20 to be movably supported along a predetermined plane which comes in contact with the plurality of rigid balls 45. The guide holes 41 are long holes extending in a direction orthogonal to a longitudinal direction of the guide member 40 (transverse direction) and are arranged along the longitudinal direction of the guide member 40. Four guide hole rows, each consisting of a plurality of (four) guide holes 41, are formed in the longitudinal and transverse directions at symmetrical positions, that is, two guide hole rows are formed in each direction. According to the circular and reciprocating rectilinear motions of the polishing disk 20, which will be described later, these guide holes 41 define range of movement of the rigid balls 45 which roll and slide with respect to the supporting surface 31*a* of the support member 31 and the back surface 20*b* of the polishing disk 20. Defining the ranges of movement of the rigid balls 45 can prevent the rigid balls 45 from falling from the supporting surface 31*a* of the support member 31. In addition, the guide holes 41 are formed such that their bottom portions have a width that is slightly smaller than that of their top portions, thereby preventing the rigid balls 45 from falling through the bottom portions of the guide holes 41. The projections 43 at both ends of the guide member 40 face the respective side surfaces of the support member 31 to guide the guide member 40 in a longitudinal direction of the support member 31. Incidentally, although the guide member 40 is supported movably in the longitudinal direction of the support member 31, it is movable only within a predetermined range in the longitudinal direction of the support member 31 so that the guide member 40 will not fall from the support member 31.

Figure 4:
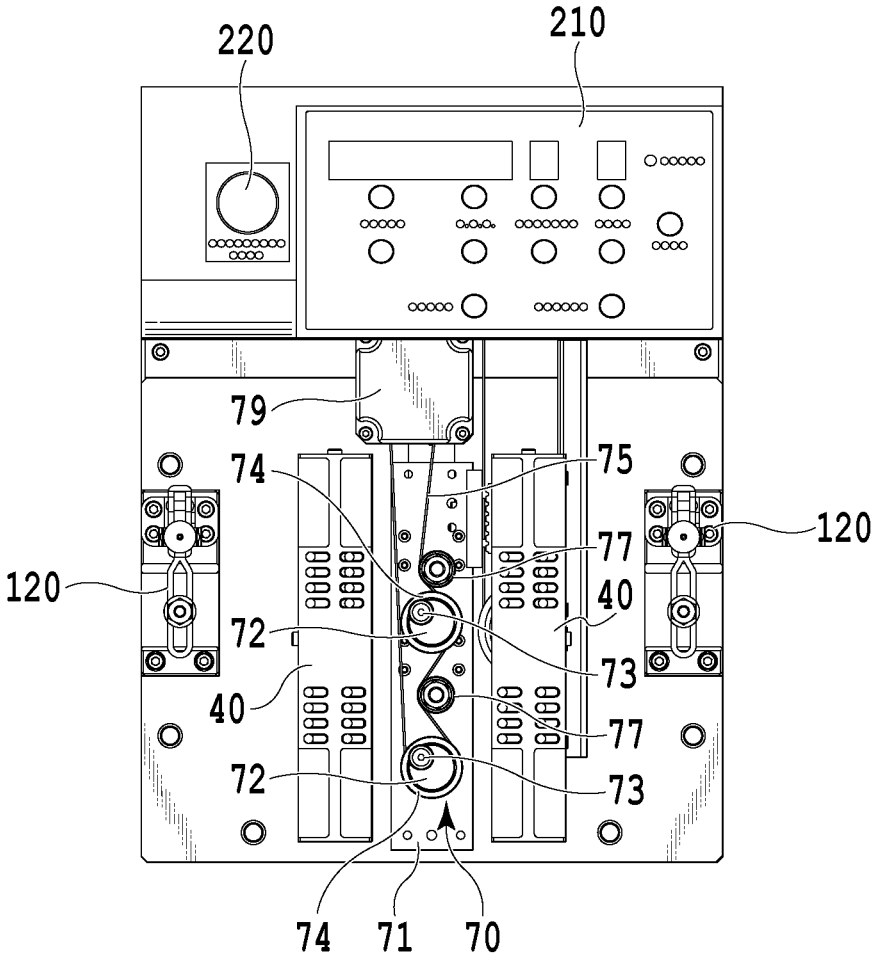
FIG. 4 is a top view of a driving mechanism for making a circular motion of the polishing disk of the polishing apparatus of FIG. 1.
Figure 5:
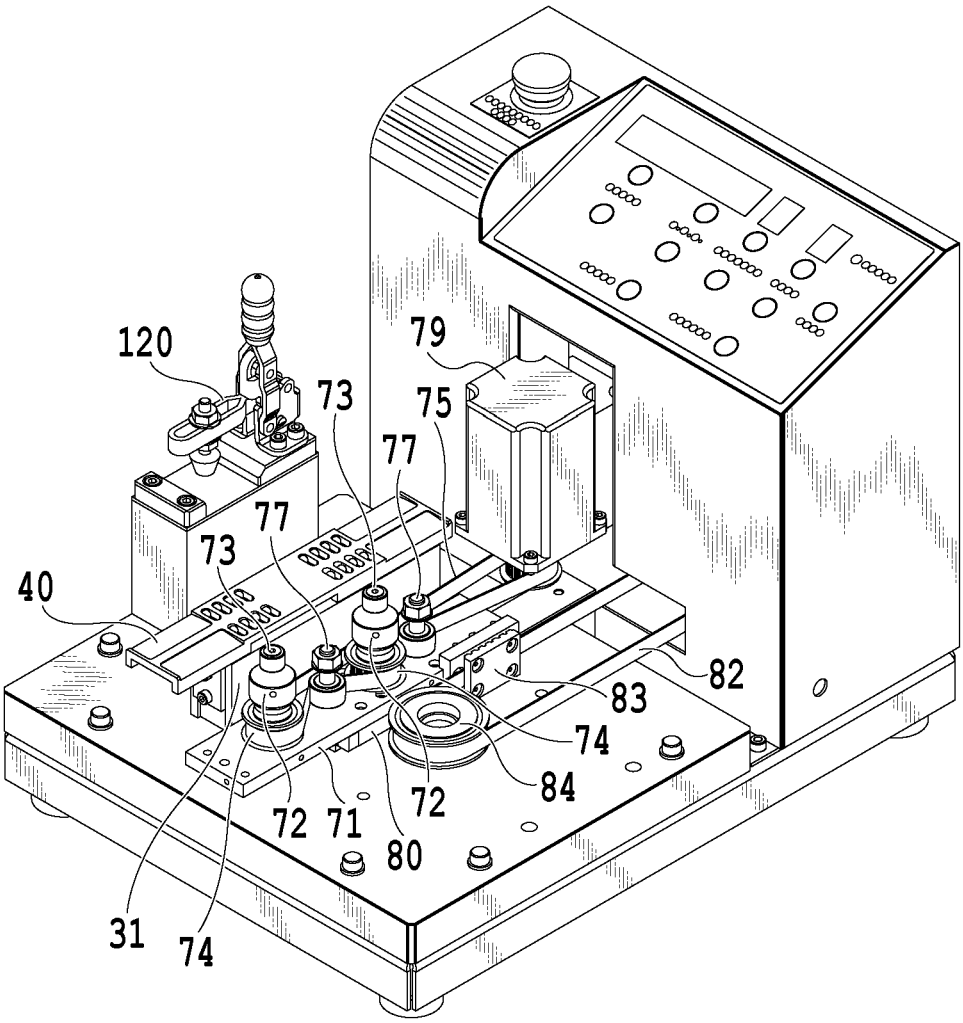
FIG. 5 is a perspective view of a driving mechanism for making circular and reciprocating rectilinear motions of the polishing disk of the polishing apparatus of FIG. 1.
Figure 6:
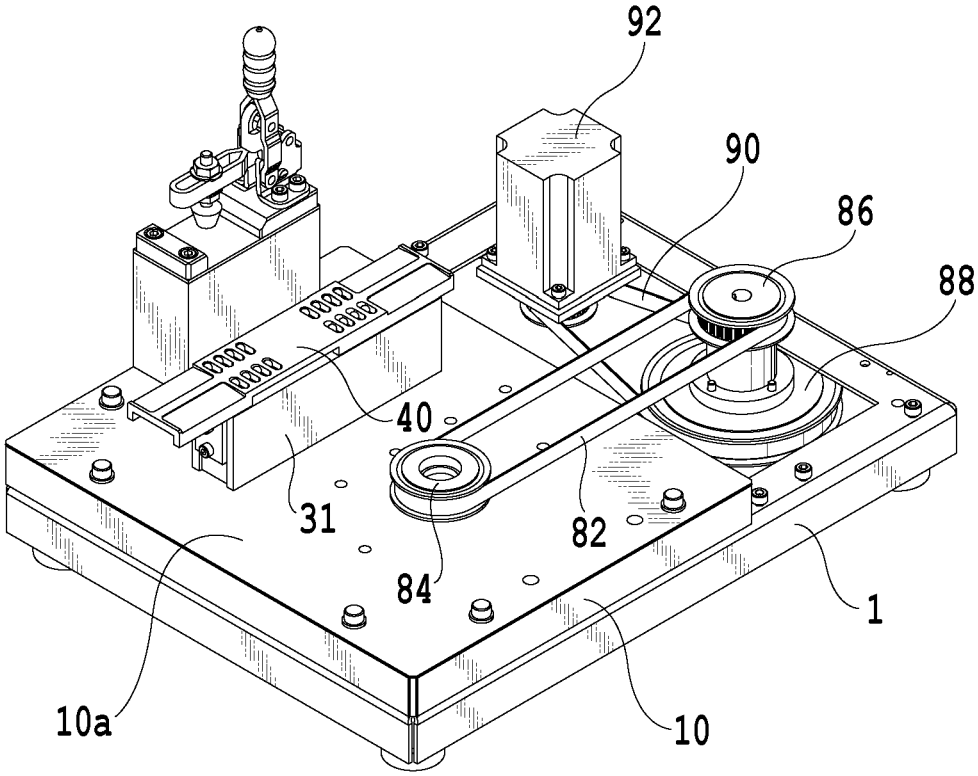
FIG. 6 is a perspective view of a power transmission system of the driving mechanism for making a reciprocating rectilinear motion.

FIGS. 4 and 5 show the polishing apparatus in which the cover of the driving mechanism 70 is removed from the polishing apparatus of FIG. 3. FIG. 6 shows the polishing apparatus in which the cover 200 and a portion of the driving mechanism 70 are removed from the polishing apparatus of FIG. 5. The driving mechanism 70 has a slider 71 which is movably guided by a direct-acting guide 80 installed on the base 10 in the longitudinal direction of the support member 31, that is, reciprocating rectilinear directions, and a plurality of (two) rotating members 72 located apart from each other on the slider and rotatably supported. The driving mechanism 70 makes a rotary motion of the rotating members 72 and a reciprocating rectilinear motion of the slider 71, thereby causing circular and reciprocating rectilinear motions of the polishing disk 20.

Each of the two rotating members 20 has an eccentric pin 73 which is deviated from its rotation center by a predetermined distance and is inserted in a pin hole 21 (see FIG. 9) formed on the back surface 20*b* of the polishing disk 20. The rotating members 72 are coupled concentrically to respective pulleys 77. The pulleys 77 are engaged with an endless synchronous belt 75, and the synchronous belt 75 is engaged with an output axis of a motor 79. A tension of the synchronous belt 75 is adjusted by a tensioner 77 which is provided for the slider 71. Rotation of the motor 79 is transmitted to the two rotating members 72 by the common synchronous belt 75, so that the two rotating members 72 rotate in synchronization with each other.

At one side portion of the slider 71, a portion of an endless belt 82 is fixed to a fixing member 83. The belt 82 is winded around a pulley 84 rotatably provided for a base 19 and is also winded around a pulley 86 rotatably provided for the pedestal 1. The pulley 86 is coupled concentrically to a pulley 88 which has a different diameter, and a belt 90 is winded around the pulley 88 and an output axis of a motor 92. Thereby, rotation of the motor 92 is converted to a rectilinear motion of the belt via the belt 90 and transmitted to the slider 71. A reciprocating rectilinear motion of the slider 71 is caused by rotating the output axis of the motor 92 alternately in clockwise and counterclockwise directions.

Figure 9:
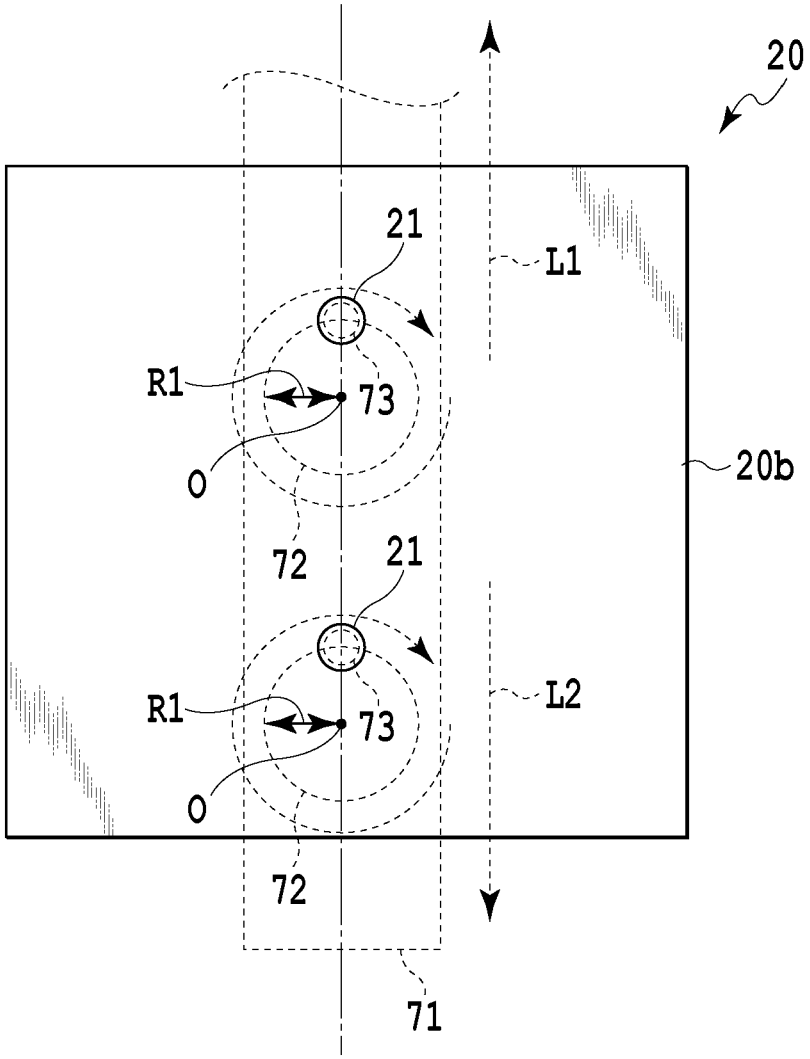
FIG. 9 is a view showing a relation between the polishing disk and the driving mechanism.

With reference to FIG. 9, circular and reciprocating rectilinear motions of the polishing disk 20 by the driving mechanism 70 will be described. Once the motor 79 is rotated in a given direction, two rotating members 72 synchronously rotate about central axes O in an R1 direction so that a circular motion of the polishing disk 20 with radius R1 defined by a distance between the central axis O and the eccentric pin 73. At this time, since the two eccentric pins 73 are engaged with two pin holes 21 of the polishing disk 20, respectively, the polishing disk 20 will not rotate. A specific amount of rotation of the motor 92 in one direction and a subsequent specific amount of rotation in the other direction of the motor 92 are repeated, so that the slider 71 moves the same distance alternately in a L1 direction and a L2 direction. Thereby, a reciprocating rectilinear motion of the polishing disk 20 is caused.

Figure 11:
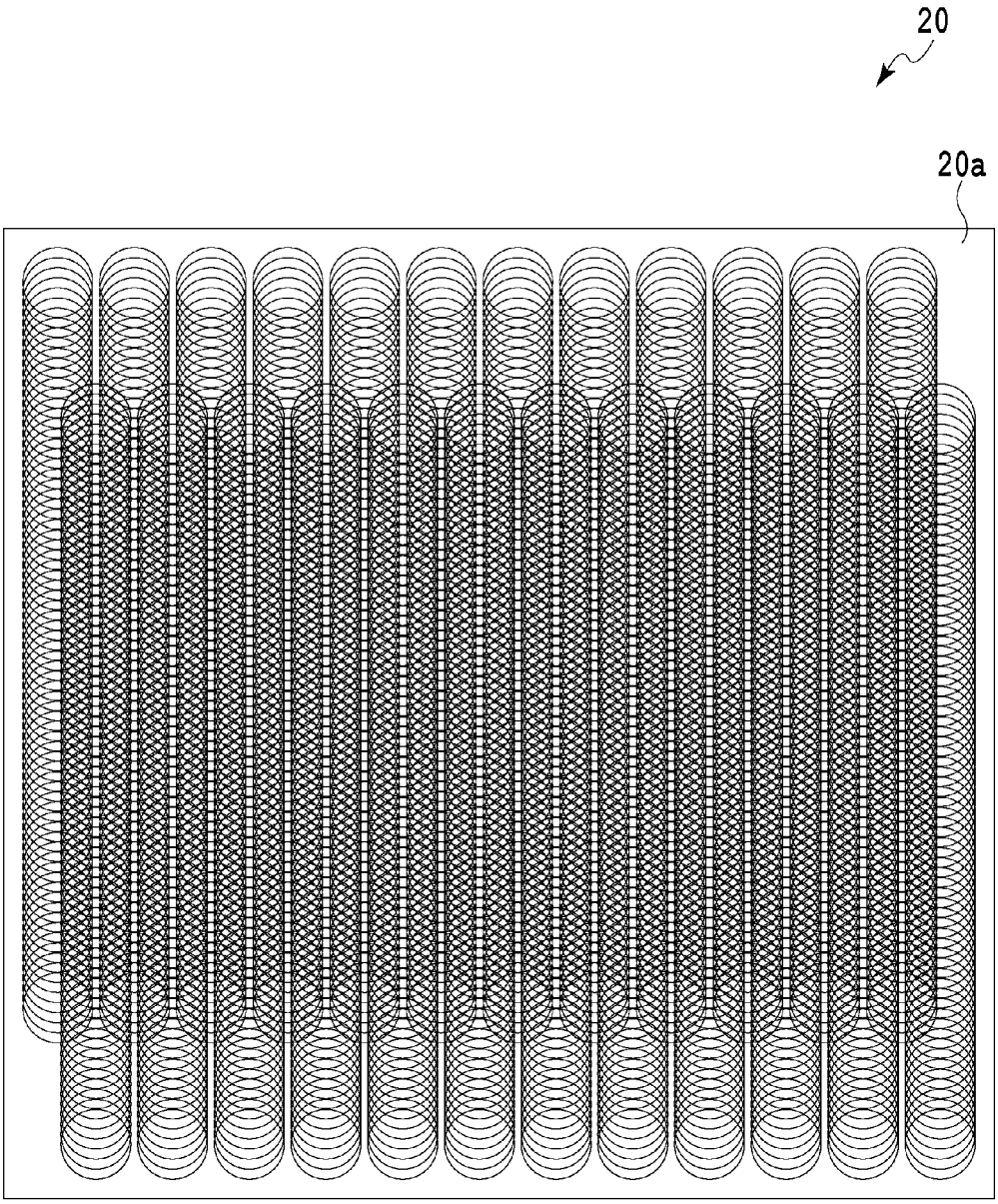
FIG. 11 is a conceptual view schematically showing movement trajectories of optical fiber ferrules of the optical connectors with respect to the polishing disk.

Here, FIG. 11 schematically shows movement trajectories of the connecting end surfaces 301*a* with respect to the polishing disk 20 when polishing the connecting end surfaces 301*a* of 24 optical connectors 300. The concurrent circular and reciprocating rectilinear motions of the polishing disk 20 allow avoiding duplication of the movement trajectories of the connecting end surfaces 301*a*.

In the polishing apparatus in accordance with the present embodiment, among the parts which wear out as they roll and slide, the plurality of rigid balls 45 are the only expendable parts which affect polishing precision of the connecting end surface 301*a* of the optical connector 300 and periodically require replacement. That is, to control the polishing precision of the connecting end surface 301*a*, it should be noted that the plurality of rigid balls 45 are particularly expendable. Accordingly, as long as the precision of the rigid balls 45, which are the only expendable parts requiring replacement periodically at relatively short cycles, are controlled, it is possible to maintain a high polishing precision of the connecting end surface 301*a*. For example, even if the eccentric pins 73 and the direct-acting guide 80 of the driving mechanism 70 wear out, the wearing out of the eccentric pins 73 and the direct-acting guide 80 will not affect the polishing precision of the connecting end surface 301*a*. Therefore, replacement cycles of expendable parts except the rigid balls 45 may be greatly extended.

In addition, the polishing apparatus in accordance with the present embodiment has a structure in which force acting between the connecting end surface 301*a* of the optical connector 300 and the polishing disk 20 during polishing concentrates on the rigid balls 45, and hardly on the driving mechanism 70, which allows further extension of the life of parts which wear out in the driving mechanism 70.

Furthermore, in the polishing apparatus in accordance with the present embodiment, the guide members 40 are provided movably for the support members 31 so that the guide members 40 will not interfere with the rolling of the rigid balls 45 as possible. That is, the guide members 40 are allowed to move in reciprocating rectilinear directions so that the guide members 40 will not interfere with the rolling of the rigid balls 45 as possible even if force acts on the rigid balls 45 for movement in a direction other than a formation direction of the guide holes 41 of the guide members 40. This allows delay in the progress of wear of the rigid balls 45.

Furthermore, in the polishing apparatus in accordance with the present embodiment, the workpiece holder is fixed so as not to make a reciprocating rectilinear motion of a workpiece mounted thereto. Therefore, an optical cable connected to an optical connector will not be bent and put under load in polishing thereby allowing the holding way of the workpiece (optical connector) to be simplified.

Figure 12:
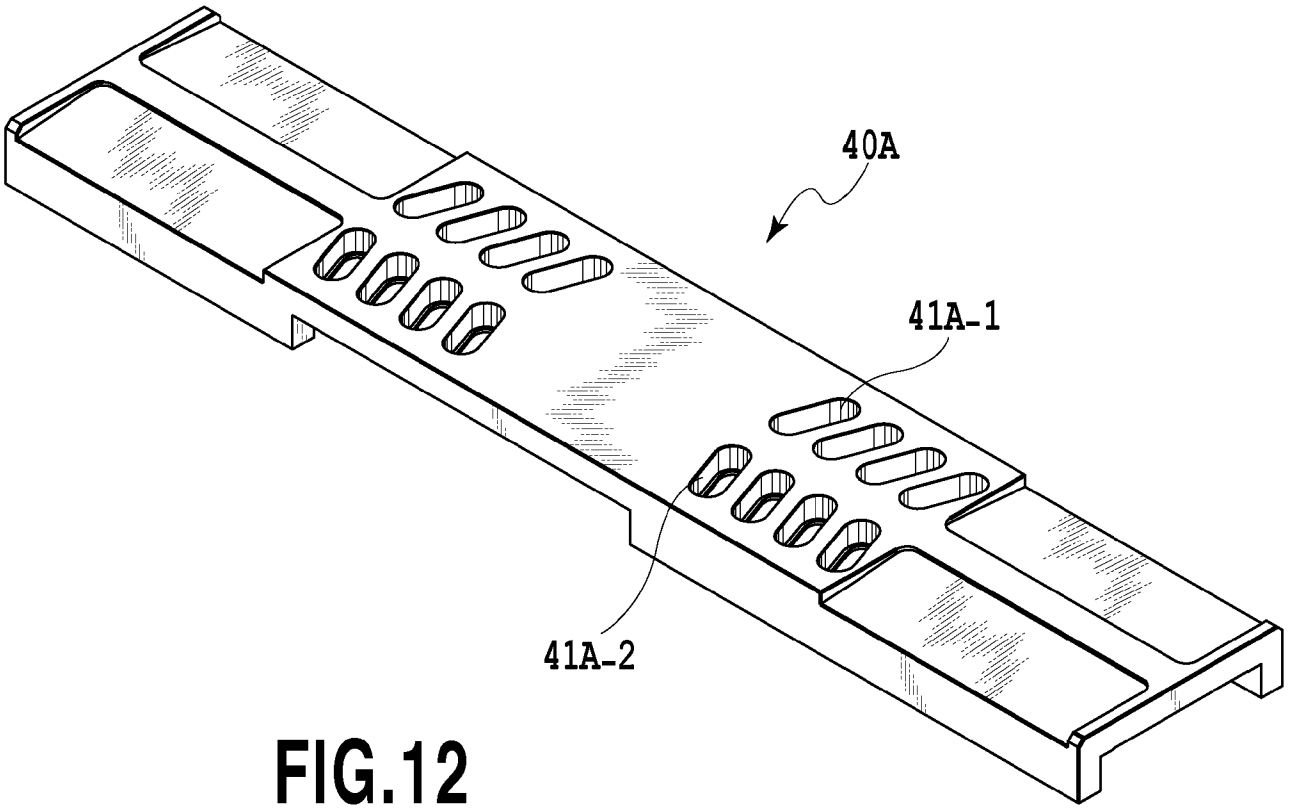
FIG. 12 is a perspective view illustrating another exemplary guide member.
Figure 13:
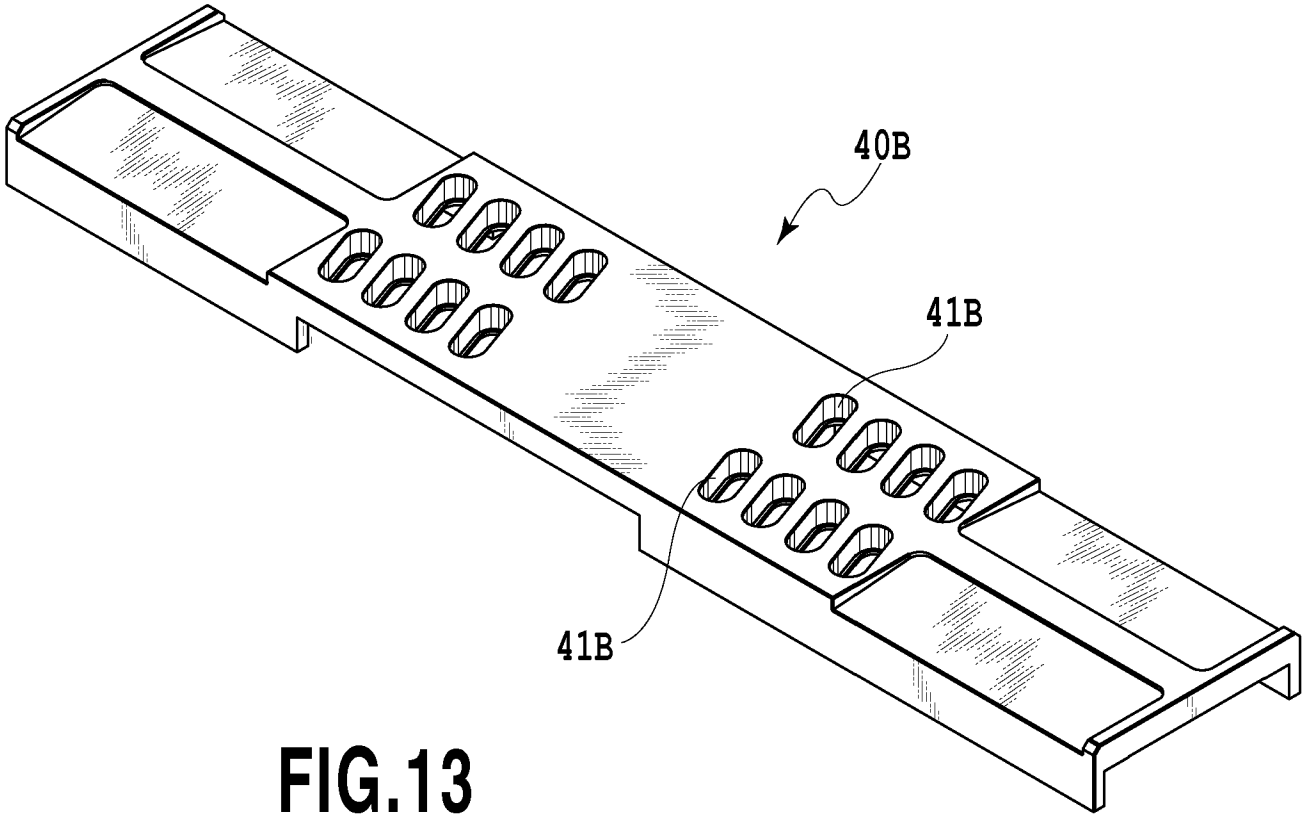
FIG. 13 is a perspective view illustrating still another exemplary guide member.
Figure 14:
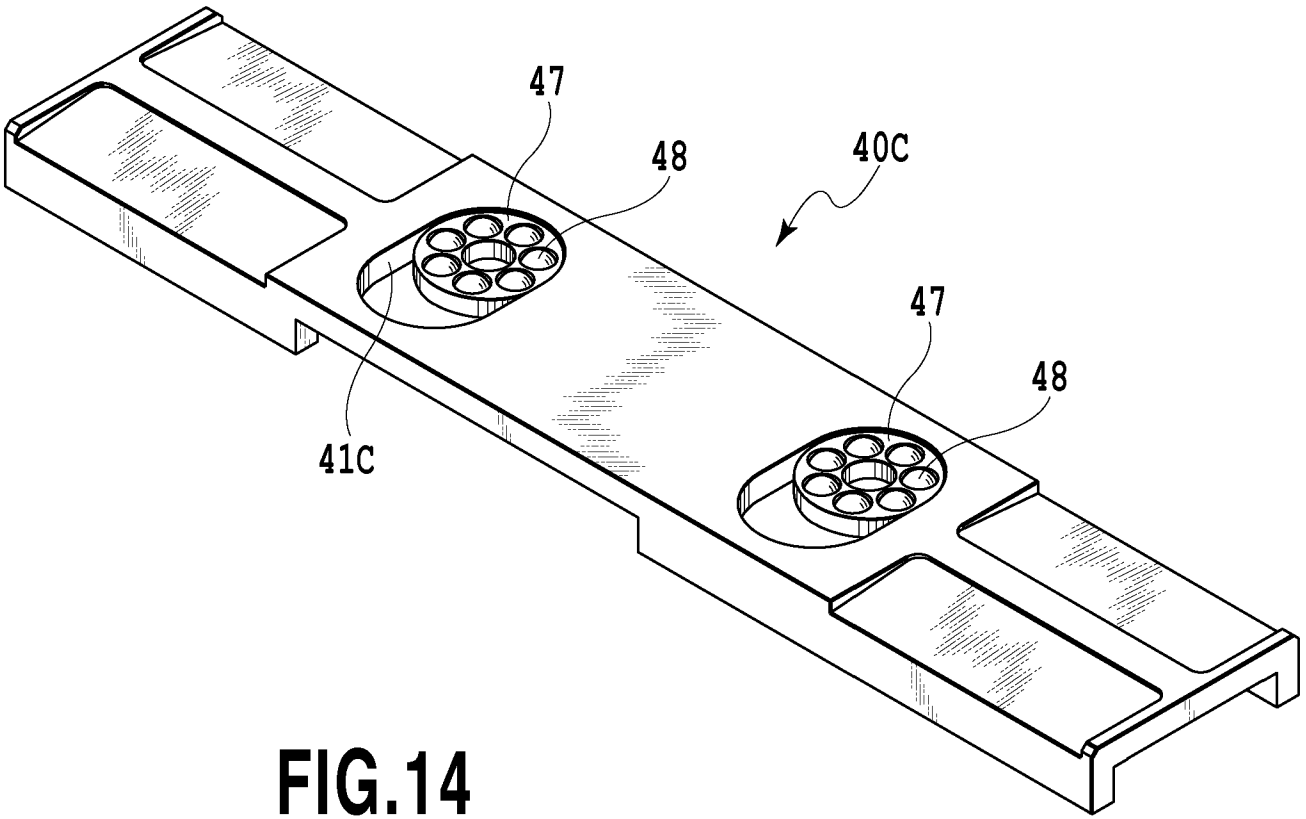
FIG. 14 is a perspective view illustrating still another exemplary guide member.

In the above-described present embodiment, a formation direction of the guide holes 41 of the guide members 40 is assumed to be a direction perpendicular to reciprocating rectilinear directions, but is not limited thereto. For example, as shown in FIG. 12, it is possible to adopt a guide member 40A having guide holes 41A_1 and 41A_2 inclined in directions opposite to each other with respect to the reciprocating rectilinear directions, or, as shown in FIG. 13, a guide member 40B having guide holes 41B all inclined in the same direction with respect to the reciprocating rectilinear directions. In the above-described present embodiment, although an example of a single rigid ball was shown as a single bearing element, the present invention is not limited thereto. For example, as shown in FIG. 14, a plurality of rigid balls 48 retained in a ring-shaped retainer 47 may be used as a single bearing element. In this case, the retainer 47 is movably guided by a guide hole 41C formed in a direction perpendicular to the reciprocating rectilinear directions.

In the above-described present embodiment, although the examples of rolling rigid balls are shown as bearing elements, the present invention is not limited thereto. For example, it is possible to adopt a sliding member having a low coefficient of friction between the polishing disk and the supporting surface, instead of a bearing element.

The invention claimed is:

1. A polishing apparatus comprising:

a polishing disk having a polishing surface for polishing an end surface of a workpiece on one side thereof;

a support mechanism configured to support a back surface of the polishing disk on an opposite side to the polishing surface while allowing the polishing disk to move along a predetermined plane;

a workpiece holder configured to hold the workpiece so as to contact the end surface of the workpiece with the polishing surface of the polishing disk; and a driving mechanism configured to concurrently cause circular and reciprocating rectilinear motions of the polishing disk, wherein the support mechanism comprises a plurality of support members installed in parallel, each having a supporting surface, and a plurality of spheres interposed between the supporting surface of each support member and the back surface of the polishing disk, so as to allow the circular and reciprocating rectilinear motions of the polishing disk with respect to the supporting surface, and a hardness of the back surface of the polishing disk and a hardness of the supporting surfaces of the support members are higher than a hardness of the spheres.

2. The polishing apparatus according to claim 1, wherein the support mechanism further comprises a plurality of guide members, each movably supported by one of the support members in directions of the reciprocating rectilinear motion, and the guide members define a range of movement of each of the plurality of spheres.

3. The polishing apparatus according to claim 2, wherein each guide member comprises a plurality of guide holes defining the range of movement of each of the plurality of spheres, and each of the plurality of guide holes extends in a direction different from the directions of the reciprocating rectilinear motion.

4. The polishing apparatus according to claim 2, wherein the plurality of support members arranged each extend in the directions of the reciprocating rectilinear motion, and the plurality of spheres and guide members are provided for each of the supporting surfaces of the plurality of support members.

5. The polishing apparatus according to claim 1, wherein the driving mechanism comprises:

a slider movably guided in the directions of the reciprocating rectilinear motion; and a rotating member rotatably supported by the slider and engaged with the polishing disk in a position deviated from a rotation center thereof by a predetermined distance.

6. The polishing apparatus according to claim 5, wherein the rotating member comprises first and second rotating members arranged apart from each other; and the driving mechanism comprises:

a synchronous belt for rotating the first and second rotating members in synchronization with each other; and a tensioner for adjusting a tension of the synchronous belt.

7. The polishing apparatus according to claim 1, further comprising a base having a reference surface, wherein the support mechanism and the workpiece holder are commonly provided on the reference surface of the base.

8. The polishing apparatus according to claim 1, wherein the end surface of the workpiece includes a connecting end surface of an optical fiber ferrule.

9. A polishing apparatus comprising:

a polishing disk comprising a polishing surface and an opposing back surface;

a driving mechanism that moves the polishing disk in concurrent circular and reciprocating rectilinear motions in a predetermined plane;

a workpiece holder adapted to hold a workpiece so that an end surface of the workpiece contacts the polishing surface of the polishing disk such that the end surface is polished by the polishing surface when the polishing disk is moved by the driving mechanism in the predetermined plane; and a support mechanism that supports the polishing disk when the polishing disk is moving in the predetermined plane, the support mechanism comprising:

a plurality of support members positioned parallel to each other, each support member having a support surface; and a plurality of spheres positioned on the support surfaces of the support members so as to contact the back surface of the polishing disk, the spheres being positioned between the back surface of the polishing disk and the support surfaces of the support members, the spheres being movable in the predetermined plane so as to support the polishing disk while the polishing disk moves in the circular and reciprocating rectilinear motions, the spheres having a hardness such that a hardness of the back surface of the polishing disk and a hardness of the support surfaces of the support members are greater than the hardness of the spheres.

10. The polishing apparatus according to claim 9, further comprising a plurality of guide members, each guide member being movably positioned on the support surface of one of the support members, the guide members each including a plurality of guide holes in which the spheres are movably positioned.

11. The polishing apparatus according to claim 10, wherein each guide member is movable along the corresponding support member in the direction of the reciprocating rectilinear motion.

12. The polishing apparatus according to claim 10, wherein each guide hole has positioned therein one of the spheres, and each guide hole extends in a direction transversal to the direction of the reciprocating rectilinear motion.

13. The polishing apparatus according to claim 10, wherein each guide member is movable along the corresponding support member in the direction of the reciprocating rectilinear motion and each guide hole extends in a direction transversal to the direction of the reciprocating rectilinear motion such that the guide members move reciprocally along the support members and the spheres move reciprocally along the guide holes when the polishing disk moves in the circular and reciprocating rectilinear motions.

* * * * *